United States Patent [19]

Hess

[11] Patent Number: 4,753,574

[45] Date of Patent: Jun. 28, 1988

[54] DEVICE FOR PRODUCING A DIRECTED FLUID FLOW

[76] Inventor: Silvan Hess, Sandbuhlstrasse 22, CH-8606 Greifensee, Switzerland

[21] Appl. No.: 943,260

[22] PCT Filed: Jun. 3, 1985

[86] PCT No.: PCT/CH85/00090

§ 371 Date: Nov. 28, 1986

§ 102(e) Date: Nov. 28, 1986

[87] PCT Pub. No.: WO86/04648

PCT Pub. Date: Aug. 14, 1986

[30] Foreign Application Priority Data

Feb. 4, 1985 [CH] Switzerland ..... 484/85

[51] Int. Cl.[4] ..... B63H 1/30; F04D 11/00

[52] U.S. Cl. ..... 416/83; 416/65

[58] Field of Search ..... 416/83, 78, 79, 65

[56] References Cited

U.S. PATENT DOCUMENTS

| | | | |
|---|---|---|---|
| 6,533 | 6/1849 | Bond | 416/83 |
| 135,257 | 1/1873 | Bainbridge | 416/83 |
| 239,565 | 3/1881 | Smith | 416/78 |
| 940,753 | 11/1909 | Tower | 416/83 |
| 1,093,693 | 4/1914 | Glenn | 416/83 |
| 1,729,676 | 10/1929 | Meindersma | 416/78 |
| 1,903,551 | 4/1933 | Meindersma | 416/78 |
| 3,215,371 | 11/1965 | Schmidt | 416/83 X |
| 3,231,220 | 1/1966 | Fischer | 416/87 |
| 3,508,840 | 4/1970 | Lederlin | 416/79 X |

FOREIGN PATENT DOCUMENTS

| | | | |
|---|---|---|---|
| 1195068 | 11/1959 | France | 416/83 |
| 216760 | 1/1942 | Switzerland | 416/83 |
| 172965 | 11/1922 | United Kingdom | 416/81 |

*Primary Examiner*—Everette A. Powell, Jr.
*Attorney, Agent, or Firm*—Stanley R. Moore

[57] ABSTRACT

A device for producing a directed fluid flow utilizing an elongate paddle member having first and second wing portions formed along a common longitudinal axis. The wing portions are orthogonally disposed relative to one another. Pivots are constructed in each of the wing portions, which pivots extend substantially perpendicular to each wing portion and are disposed orthogonally relative to each other. First and second rotatably driven shafts are disposed in generally parallel spaced relationship and are coupled to the pivots by a hinge and swivel arm connected to each shaft at one end and to the pivot at the other end. The rotatably driven shafts then define a notional plane and the rotation of the shafts causes rotation of the paddle member for generating directed fluid flow generally perpendicular to the notional plane.

7 Claims, 4 Drawing Sheets

DEVICE FOR PRODUCING A DIRECTED FLUID FLOW

Figure 2:
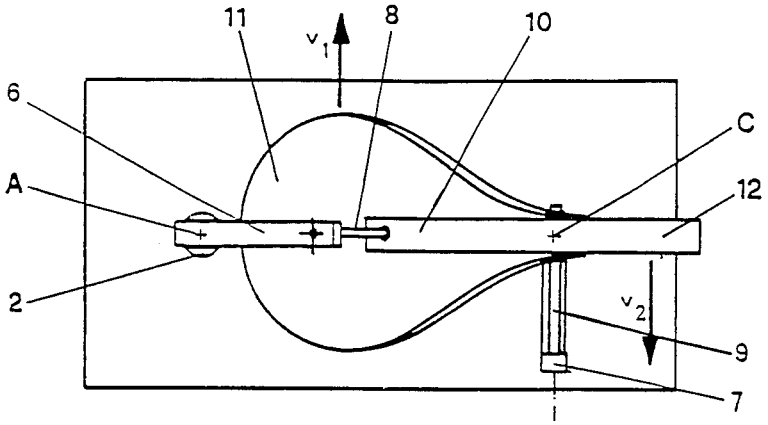

This invention is a device for producing directed fluid flow, whether the fluid is a pure substance, a solution or a mixture of different fluids, suspensions, liquids of fluids of a similar nature.

Many kinds of devices producing a directed fluid flow are known: they may be divided into various types and used in a wide range of applications. Classification of these devices by application yields two basic groups: a device either set a fluid in motion while the device itself remains fixed in place, as in pumping devices, or a device may be mounted on a movable support in the flowstream such that both the fluid and the support-mounted device are set in motion, and the device is driven like a boat in water.

In both cases, fluid pumps as well as watercraft propulsion equipment, similar devices are employed: propellers and screws of various designs and millwheel-like devices with paddles extending into the fluid.

It is known that propellers and screws in general having low efficiency ratings. In addition to the transfer of momentum axially, which is the only vector that moves the craft forward or produces a flowstream, fluid is also moved radially and tangentially to a considerable extent, and this is a waste of energy in many cases. By jacketing the propeller and using baffle plates to reduce tangential flow, their efficiency can be improved. But considerable flow losses occurring at the propeller itself due to enormous tangential forces cannot be eliminated. This is true for pumps as well as watercraft propulsion equipment. In the case of large high-RPM propellers, the well-known and undesirable phenomenon known as cavitation also arises. Cavitation is caused by additive steam voids which occur when local pressure falls below the steam partial pressure of the fluid being moved. This is also a consequence of radial fluid flow.

In vane-type devices, whether they are used in pumping or propulsion applications, some of the disadvantages of propellers and screws are eliminated, to be sure, but such devices are usually built in quite large versions, and because of their roughly uniform movement through the water, there is relatively little variation in moment transfer.

Furthermore, in these types of propulsion devices, there is fluid turbulene along the edges of the vanes, which consumes a considerable portion of the energy of propulsion while contributing nothing to forward movement; on the contrary, it creates turbulent water, which is especially dangerous for canal traffic.

The problem behind this invention was to develop a propulsion device providing the largest possible transfer of momentum in a given direction and thus create as little turbulence as possible in the fluid.

The problem was solved in this invention as follows: a paddle-shaped body, gimbal-mounted on two shafts, which are perpendicular to each other and rotate in opposite directions, and two additional gimbal-mounted shafts, which are perpendicular to the first two shafts and also rotate in opposite directions, such that the distance between all four shafts rotating in opposite directions is equal and such that both cardan shaft also extend perpendicularly through the two parallel drive shafts, so that the double motion of the latter two parallel shafts imparts an inverted kinematic motion to the paddle-shaped body.

For the purposes of general illustration, the attached drawings show possible designs of the invention.

Figure 1:
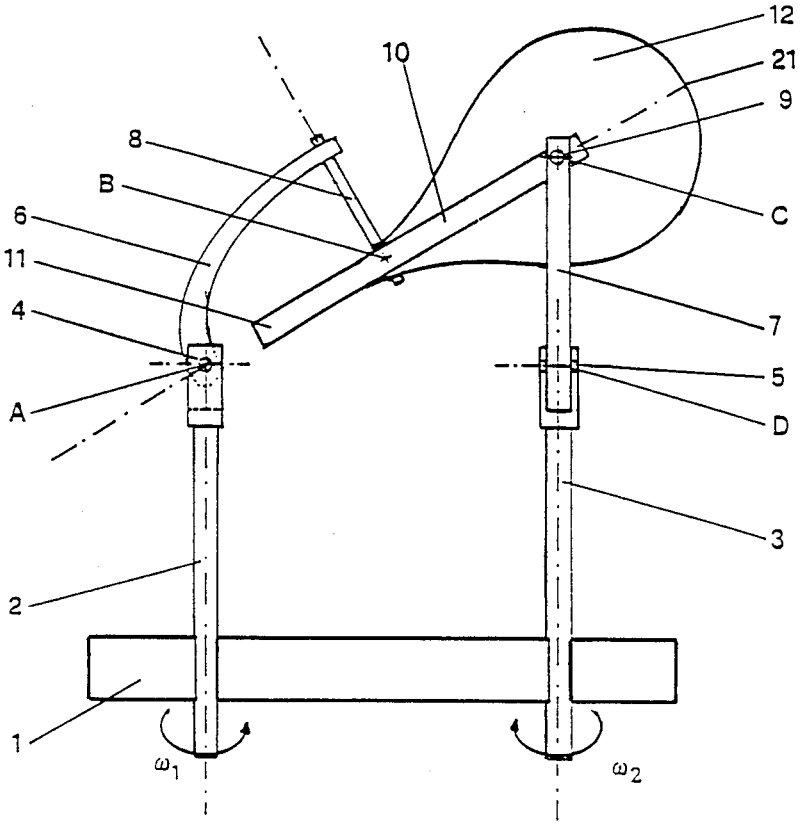

FIG. 1. An Example of the Design (Side View)
FIG. 2. An Example of the Design (Top View)
FIG. 3. View of a First Paddle-Shape Body
FIG. 4. A Second Example of the Design (Top View)
FIG. 5. Top View of the Example Shown in FIG. 4
FIG. 6. View of a Second Paddle-Shaped Body
FIG. 7. A Third Example of the Design (Side View)
FIG. 8. Top View of the Example Shown in FIG. 7

The example shown in FIG. 1 consists of a base plate (1) on which two parallel shafts (2, 3) are mounted so that they can rotate. There are knuckle joints (4 and 5) at the ends (A and D) of shafts 2 and 3 which attach shafts peripendicular to shafts 2 and 3; an extension of the shaft attached to joint 5 extends through end A. Ends A and D are both at the point of intersection of the axes of shafts 2 and 3 with the axes of joints 4 and 5.

Stirrup-type mountings (6, 7) provide swivel action at joints 4 and 5; shafts 8 and 9 extend through the ends of these stirrup-type mountings such that the axes of shafts 8 and 9 are peripendicular to the axes of joints 4 and 5. The axes of shafts 8 and 9 are also perpendicular to each other. Shafts 8 and 9 extend through a double paddle (10), to which they are attached so that they can swivel. A similar swivel configuration is known from CH-PS No. 216 760, where the device has a hollow body containing, for example, liquid to be mixed in.

The points where the longitudinal axis of the body (10) intersects with the shafts (8 and 9) are marked B and C. In the design shown in FIG. 1, the distances between points A, B, C and D are such that AB=BC=CD.

Figure 3:
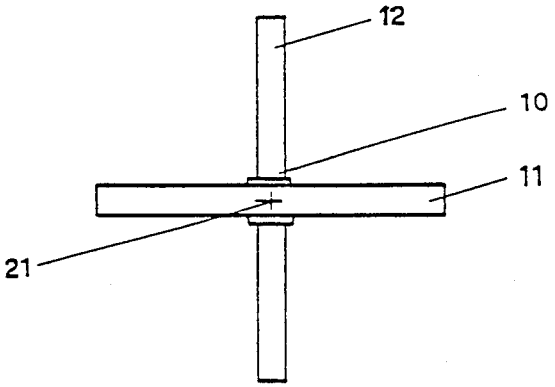

FIG. 2 is a top view of the same design as that shown in FIG. 1 with the body (10) in the same position. The latter is divided into two paddle-shaped parts (11 and 12) in two perpendicular planes such that the line of intersection between these two planes coincides with the longitudinal axis (21) of the body (10) and passes through points B and C.

The two shafts (2 and 3) rotate in opposite directions at non-uniform angular velocities $\omega_1$ and $\omega_2$ at a phase displacement of $\pi/2$. In a complete revolution, two maximum and two minimum values with a ratio of 2:1 are achieved.

If shaft 3 rotates in the direction of angular velocity $\omega_2$, part 12 of the body (10) delivers a rapid paddling motion toward the observer, while part 11 of the body (10) slowly moves away from the observer. After a quarter-rotation of the shafts (2 and 3), part 11 swings up to the left, then moves more rapidly toward the observer, whereas part 12 swings down to the right, moving away from the observer. As the shafts (2 and 3) make a full revolution, the body (10) makes four jerky movements: each part (11 and 12) alternately moves twice. Due to the inventive design of the body (10), flow resistance is greatest in the position and motion of part 12 as shown in FIG. 1 and least in the position of part 11.

During a complete rotation of shafts 2 and 3, parts 11 and 12 change position and direction of motion four times, and body 10 makes a full rotation around its longitudinal axis (21), which is not fixed in space.

The direction of its movement in the position shown in FIGS. 1 and 2 is indicated in FIG. 2 by the arrow ($v_1$ and $v_2$).

FIG. 2 shows the body (10) as seen from Point A. The two parts (11 and 12) are perpendicular to each other.

Figure 5:
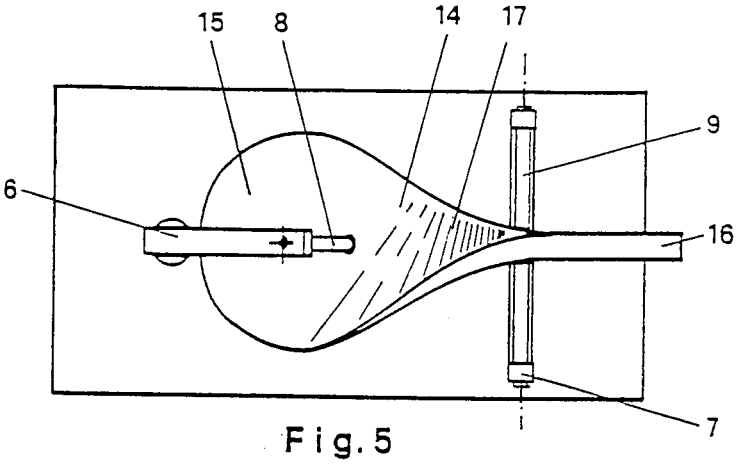
Figure 4:
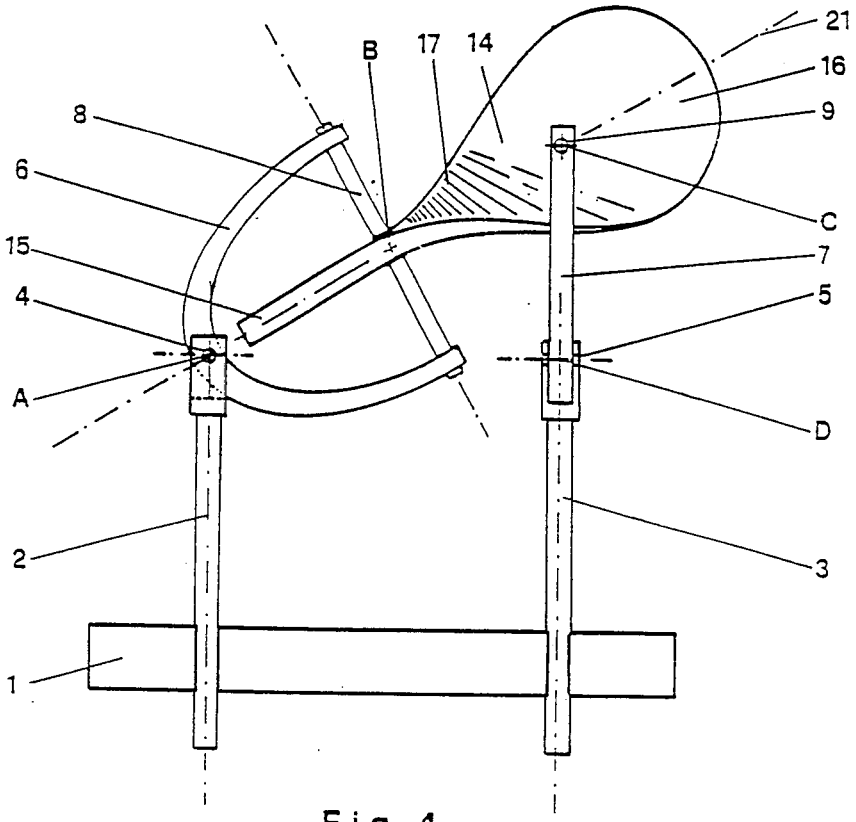

FIGS. 4 and 5 illustrate a second inventive design of the device. The basic elements, i.e., the gimbal configuration, remain the same as in FIGS. 1 and 2, but the body (10) is replaced by another body (14): in addition, the stirrup-type mountings (6 and 7) are designed in such a way that they fix and support the shafts (8 and 9) at both ends. The body (14) is again divided into two essentially flat parts (15 and 16) peripendicular to each other, whose transitional area is fluted.

Figure 6:
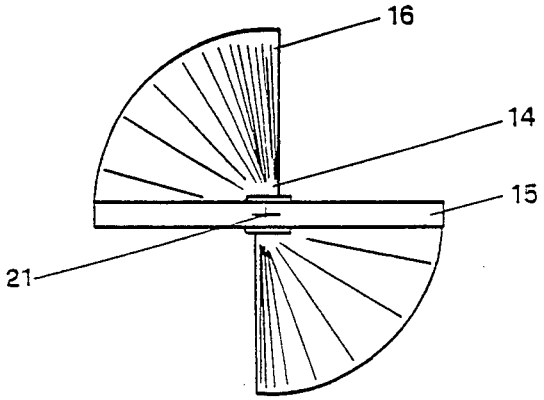

FIG. 6 also shows the body (14) as viewed from Point A. Note the two perpendicular parts (15 and 16) and the transitional area 17.

Another possible variation of the sample design illustrated in FIGS. 4, 5 and 6, which is not shown here, has a body (14) whose entire surface is determined by a helix wrapped around the longitudinal axis (21) of the body (14). A subvariant of this design has a body (14) along a helical arc, e.g., an elliptical segment along the longitudinal axis (2) of the body (14).

Figure 8:
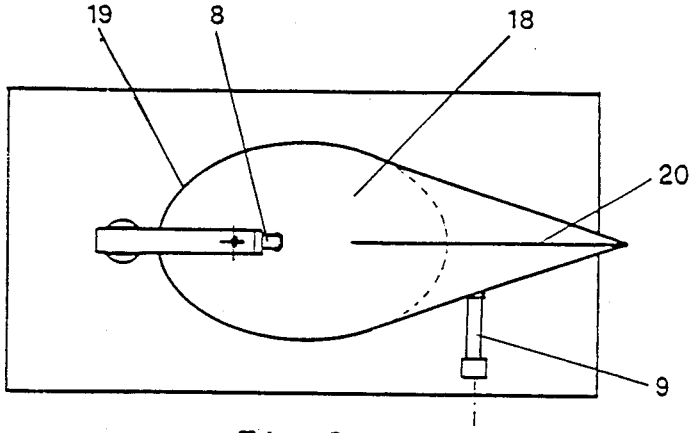
Figure 7:
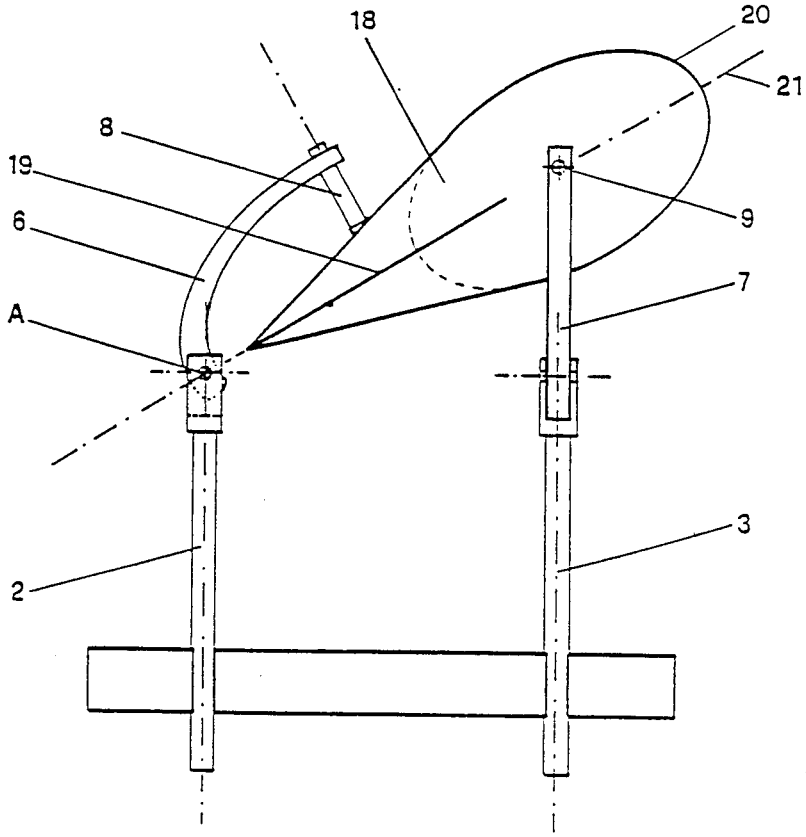

FIGS. 7 and 8 illustrate a third sample inventive design. The drive train, consisting of shafts 2 and 3, the stirrup-shaped mountings 6 and 7 and shafts 8 and 9, which are periendicular to each other, is complemented by a body (18). This body (18) is a three-dimensional structure defined by a fluted surface formed by two ellipses (19 and 20) arising from a plane. The two ellipses (19 and 20) are perpendicular to each other. The shafts (8 and 9) run through the centers of the ellipses (19 and 20).

I claim:

1. A device for producing a directed fluid flow, said device comprising:

an elongate paddle member having first and second wing portions and a common longitudinal axis;

said wing portions being orthogonally disposed relative to one another about said common longitudinal axis;

pivot means constructed in each of said wing portions, each of said pivot means extending substantially peripendicular to said wing portion and being disposed orthogonally relative to each other;

first and second rotatably driven shafts, said shafts being in generally parallel spaced relationship;

a hinge defining a swivel access connected to and extending perpendicularly from each respective shaft;

a swiveling arm hingedly connected to each shaft at said hinge and at the other end to said pivot means in said wing portions;

the distance between said pivot means being substantially equal to said length of said swiveling arm between said hinge and said pivot means connection; and said rotatably driven shaft defining a notional plane and said rotation thereof causing rotation of said paddle member for generating directed fluid flow generally peripendicular to said notional plane.

2. The apparatus as set forth in claim 1, wherein each of said wing portions of said paddle member is formed by a plate, said plates of said wing portions being connected to each other along a part of said longitudinal axis of said paddle member and being perpendicular to the other.

3. The apparatus as set forth in claim 1, wherein each of said wing portions of said paddle member comprises a substantially flat outer section connected to a common central section of said paddle member, said central section having a surface helically shaped around said longitudinal axis.

4. The apparatus as set forth in claim 1, wherein said wing portions are helically shaped, each being disposed in an angular orientation around said longitudinal axis, said angular orientation being on the order of 45 degrees.

5. The apparatus as set forth in claim 4, wherein said helically shaped wing portions have a generatrix formed by a straight line extending perpendicular to said longitudinal axis.

6. The apparatus as set forth in claim 4, wherein said generatrix is curvilinear.

7. The apparatus as set forth in claim 1, wherein said paddle member comprises a body having a closed surface defined by two ellipses oriented perpendicularly relative to each other, intercepting each other along said common longitudinal axis and having their centers displaced along said axis for a given distance and further defined by a family of lines extending between said two ellipses, each of said ellipses defining one of said wing portions.

* * * * *